United States Patent [19]

Baker

[11] Patent Number: 4,595,430

[45] Date of Patent: Jun. 17, 1986

[54] DESENSITIZED DYNAMITES

[75] Inventor: James J. Baker, Sugarloaf, Pa.

[73] Assignee: Atlas Powder Company, Dallas, Tex.

[21] Appl. No.: 607,773

[22] Filed: May 7, 1984

[51] Int. Cl.[4] ..... C06B 25/00

[52] U.S. Cl. ..... 149/88; 149/48; 149/53; 149/63; 149/65; 149/95; 149/101; 149/102; 149/103; 149/104; 149/105

[58] Field of Search ..... 149/101, 88, 95, 48, 149/53, 63, 65, 105, 102, 103, 104

[56] References Cited

U.S. PATENT DOCUMENTS

| | | | |
|---|---|---|---|
| 2,676,877 | 4/1954 | Glogau | 52/11 |
| 3,116,188 | 12/1963 | Austin | 149/88 |
| 3,617,409 | 11/1971 | Harris | 149/48 |
| 3,755,021 | 8/1973 | Sujansky | 149/103 |
| 4,292,098 | 9/1981 | Mastroianni et al. | 149/101 |

OTHER PUBLICATIONS

Affidavit of Slawinski Relating to the Desensitized Dynamite Experimental Program.

Affidavit of John Mains Relating to the Shipment of Experimental Product, RXL-542, to Climax Molybdenum Company.

*Primary Examiner*—Stephen J. Lechert, Jr.

*Attorney, Agent, or Firm*—Richards, Harris, Medlock & Andrews

[57] ABSTRACT

This invention relates to improved desensitized dynamites, the improvement comprising the incorporation of a desensitizing compound selected from the class of compounds known as diesters, polyesters, triesters except those esters containing benzyl rings, and dialkyl substituted amides or combinations thereof.

18 Claims, No Drawings

DESENSITIZED DYNAMITES

TECHNICAL FIELD

This invention relates to explosives, and in particular the desensitization of dynamites by use of desensitizing compounds selected from diesters, polyesters, triesters, but excluding those esters containing benzyl rings; and dialkyl substituted amides.

BACKGROUND ART

Dynamite is a mixture of nitroglycerin and/or ethylene glycol dinitrate (hereinafter referred to as "EGDN") along with various nitrate salts and carbonaceous absorbants. Although those in the art frequently use NG to refer to either or both nitroglycerin, EGDN, other nitrate esters or mixtures of these, herein "NG" is used herein to refer to nitroglycerin. Herein, the term "nitrate esters" will be used to indicate a nitrate ester such as nitroglycerin, EGDN, and DNT or mixtures of two or more nitrate esters. Dynamite is a hazardous material, both to manufacture and use. The hazards involved in utilizing dynamite result from its sensitivity. In the explosives art, sensitivity is the relative ease with which a particular explosive may be detonated by a particular impulse, for example, impact, explosion, fire or friction. To lessen the hazard of accidental initiation, the widespread use of ANFO became common in the industry. ANFO is ammonium nitrate fuel oil mixture and is relatively insensitive to detonation except by the use of a booster charge. ANFO had the disadvantage of being deactivated by water. The explosive industry then developed water gels and emulsion explosives based upon the ANFO formulation. These products were both relatively insensitive to accidental detonation and also resistant to deactivation by water.

However, there continue to be many applications where there is no substitute for dynamite. Dynamite has several advantages over ANFO, water gels or emulsions, such as, reliability and energy, which render it very useful. Thus, dynamite continues to be manufactured and sold in large quantities. The two greatest hazards associated with dynamite usage are: (1) impact and friction sensitivity, and (2) a fume generation. Two types of fumes are associated with dynamite. The vapor pressure of both nitroglycerin and EGDN are small but finite and thus vapors escape from the dynamite. These fumes are undesirable because they are physiologically very active and cause headaches, nausea and other discomforts due to their vascular dilating activity. Another type of fume generation is the fume resulting from the reaction products. The fumes can be toxic. The various reactants must be stoichiometrically balanced to prevent formation of the toxic gases carbon monoxide (CO) or the oxides of nitrogen ($NO_x$). Further, the reaction must proceed essentially to completion to insure complete reaction and prevent formation of toxic gases.

Cartridges of explosives must also propagate in the borehole, i.e. One cartridge exploding must also cause a second adjacent cartridge to detonate. Problems arise in actual use, e.g. due to poor loading conditions. A ragged hole might prevent the second cartridge from being in contact with the first. In this case, the explosive must propagate across an air gap (the separation between the two cartridges). The industry uses a half-cartridge gap test to determine the ability of the explosive to propagate across a gap. Basically, the test requires that one-half of a cartridge of explosive be able to detonate a second half of a cartridge across an air gap. The Bureau of Mines requires that "permissible" explosives, i.e. those approved for use in gassy underground coal mines, must propagate across at least a three-inch gap.

Several explosive companies incorporate dinitrotoluene (DNT) as a "phlegmatizing" (desensitizing) agent in dynamite. Normally, approximately 10% DNT is utilized. Unfortunately, DNT is a suspected carcinogen. Thus, utilization of DNT substitutes a health hazard for increased safety. Furthermore, DNT severely affects the detonation properties of the explosive mixtures, for example, its use severely reduces the detonation velocity. Thus, DNT is not a desirable desensitizing agent based upon possible health hazards and substantial decrease in performance.

Other desensitizers used previously included ethylene oxide adducts. These are handicapped by the "common solvent" technique. This technique uses a compound that is soluble in each of two mutually insoluble compounds to increase the solubility of the two compounds in each other. In dynamite, the mutually insoluble compounds are external water and nitroglycerin. Ethylene oxide adducts are soluble in both. A problem with the ethylene oxide use is that one would expect it to increase the solubility of water into the nitroglycerin, thereby decreasing the water resistance of the dynamite.

The prior art also has utilized dibutyl phthalate as a desensitizing compound for dynamite. The use of dibutyl phthalate has the disadvantage of reduced sensitivity, for example, the dynamite fails to satisfy the three cartridge propagation test. This test consists of placing three cartridges end to end to determine whether detonation will propagate from the end of one cartridge through the end of the third cartridge. Even though dibutyl phthalate has poor sensitivity to propagation as determined by the three cartridge test, dynamites incorporating dibutyl phthalate are more sensitive to initiation by impact than would be expected.

Thus far, the ideal desensitizer for dynamite has escaped the art and would possess the following characteristics. It would (a) be miscible with nitroglycerin, thus keeping the desensitizing agent where it would do the most good, i.e., not migrate away from the nitroglycerin; (b) desensitize the nitroglycerin; (c) be nontoxic; (d) have minimal effect on detonation properties; (e) have a low vapor pressure to aid in suppression of fumes; (f) be water insoluble, thereby preventing degradation in wet environments; (g) be a liquid for ease of handling and measuring; and (h) have a low freezing point such that it would not freeze and separate from the nitroglycerin.

The present invention addresses these needs and provides for the desensitization of dynamite with only minimally reduced detonation performance. Further, the desensitizers of the present invention greatly lower the fumes given off from the product. Significantly, the present invention also improves safety in the production process because the desensitizing agent can be added to the liquid explosive right after nitration which occurs early in the production process.

SUMMARY OF THE INVENTION

In one aspect the present invention relates to a desensitizer for dynamite selected from diester compounds of the type:

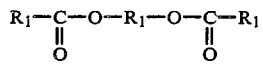

or

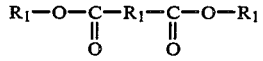

or

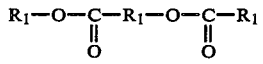

wherein $R_1$, is a $C_3$ to $C_{10}$ group, but does not include benzyl rings, which can contain elements other than carbon and hydrogen. The desensitizer may be a combination of diester compounds. The diester desensitizer of the present invention is incorporated into the dynamite in a range of from about 0.5% to about 5.0% by weight and preferably from 1.5% to 2.5% by weight.

In another aspect the present invention relates to polyester desensitizing agents of the type represented by the general formula:

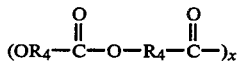

where X represents the average number of repeating units which make up the compound. $R_4$ can be the same or different carbon-containing groups but does not include benzyl rings. Such groups as adipates, sebacates, gluterates, oleates, stearates, etc., are known within the art and are available commercially by various manufacturers. These compounds are supplied mainly as plasticizers to the plastics industry. Molecular weights can vary from 1500–10,000 with the preferred range being 1900–5000.

In another aspect the present invention relates to triester components based on glycerol.

In another aspect the present invention relates to the desensitization of dynamite by the incorporation of dialkyl substituted amides of the general formula

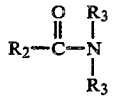

wherein $R_2$ is a $C_8$ to $C_{20}$ group and $R_3$ are $C_1$ to $C_3$ groups. $R_2$ and $R_3$ may contain elements other than hydrogen and carbon, but preferably do not. The $R_3$ groups are preferably methyl groups. The desensitizer may be a combination of dialkyl substituted amides. The desensitizing dialkyl substituted amide of the present invention is incorporated into dynamite composition in the range of from about 0.5% to about 5.0% by weight and preferably from about 1.5% to about 2.5% by weight.

In yet another aspect the present invention relates to a dynamite desensitized by incorporation of the disclosed desensitizers. A preferred desensitized semi-gelatin dynamite composition is disclosed of the general formula:

| Ingredient | Weight Percent |
|---|---|
| Nitroglycerin | 2.0 |
| Ethylene glycol dinitrate | 18.0 |
| Nitrocotton | .2 |
| Desensitizer | 2.5 |
| Oxidizer Salts (AN, SN, etc.) | 72.3 |
| Carbonaceous Fuels | 3.0 |
| Guar Flour | 1.0 |
| Chalk | 1.0 |

A preferred desensitized gelatin dynamite is disclosed of the following general formula:

| Ingredient | Percent Nitroglycerin |
|---|---|
| Nitroglycerin | 2.6 |
| Ethylene glycol dinitrate | 23.4 |
| Nitrocotton | 1.0 |
| Desensitizer | 1.5 |
| Oxidizer Salts (AN, SN, etc.) | 65.5 |
| Carbonaceous Fuels | 4.0 |
| Sulfur | 1.0 |
| Chalk | 1.0 |

All ingredients referred to above, with the exception of the desensitizer, are well known to those experienced in the art.

The preferred desensitizers are triethylene glycol caprate caprylate whose formula is:

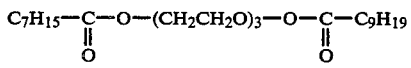

This compound is sold by C. P. Hall Company of Chicago, Ill. under the trademark Plasthall 4141. Another preferred desensitizer is a mixture of diester compounds made utilizing naturally occurring mixture of $C_4$–$C_9$ dicarboxylic acids reacted with a mixture of isodecyl and 2-ethylhexanol. An "average" compound representing the mixture would be:

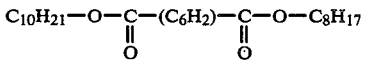

This composition is sold by Emery under the trademark Plastolein 9065.

Another preferred desensitizer of the present invention is triethylene glycol dipelargonate which contains two $C_8$ alkyl groups separated by a triethylene glycol and has a general formula:

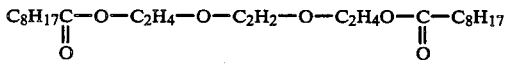

This composition is sold by Emery under the trademark Plastolein 9404. Another preferred desensitizer is N, N-dimethyl oleamide of the formula:

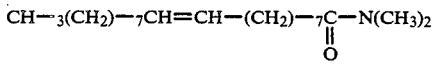

This composition is commercially available from C. P. Hall under the trademark M-18-OL.

DETAILED DESCRIPTION

The present invention provides for a desensitized dynamite utilizing novel desensitizing agents of a general formula:

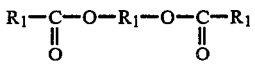

or

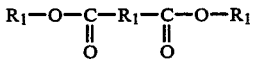

or

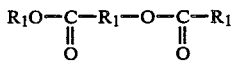

where $R_1$ is a $C_3$ to $C_{10}$ group which can contain elements other than hydrogen and carbon but which are not benzyl rings. It is not necessary that each $R_1$ in the above compounds contains the same number of C groups.

A second class of compounds which are also effective as desensitizers within the scope of the present invention consists of a class of dialkyl substituted amides

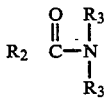

where $R_2$ is a $C_8$ to $C_{20}$ group and $R_3$ are $C_1$ to $C_3$ groups, preferably the $R_2$ and $R_3$ groups do not contain elements other than carbon and hydrogen although other elements may be present. Most preferably both $R_3$ groups are methyl groups.

Other compounds within the general class of esters compounds which meet most of the established criteria are polyesters, phosphate esters, and triesters.

Polyesters represented by the general formula

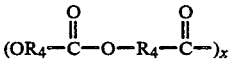

where X represents the average number of repeating units which make up the compound. $R_4$ can be the same or different carbon-containing groups but not to include benzyl rings. Such groups as adipates, sebacates, gluterates, oleates, stearates, etc., are known within the art and are available commercially by various manufacturers. These compounds are supplied mainly as plasticizers to the plastics industry. Molecular weights can vary from 1500–10,000 with the preferred range being 1900–5000.

These compounds can be thought of as polymers composed of repeating diester units. The general formula, as written, closely resembles that of the general diester compounds described above.

Suitable phosphate esters include tricresol phosphate (sold commercially as, e.g, Kronitex TCP), tri-isopropyl phenyl phosphate (e.g. commercially sold as Kronitex 100).

Suitable triester compounds based on glycerol such as glyceryl triacetate, commonly known as Triacetin, and glyceryl tripropionate, known as triproprionin. Both are sold commercially by Eastman Kodak.

In the preferred embodiments of the present invention there are three preferable diester desensitizers which are:

(A) Triethylene glycol caprate caprylate

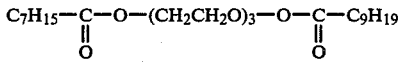

This compound is commercially available from C. P. Hall Company of Chicago, Ill. under the trademark Plasthall 4141.

(B) A mixture of diester compounds made from naturally occurring mixtures of $C_4$ to $C_9$ dicarboxylic acids reacted with a mixture of isodecyl and 2-ethyl hexanol. The "average" compound represented by this mixture is:

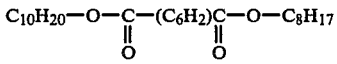

In this case, the term "average" refers to an empirical average of the compounds resulting from the reaction of the naturally occurring dicarboxylic acids with the alcohols. The compound listed represents the "median compound" present. It is not known whether the pure compound would be more or less effective than the commercial product.

This product is available from Emery under the trademark Plastolein 9065.

(C) The third diester is triethylene glycol dipelargonate having the formula:

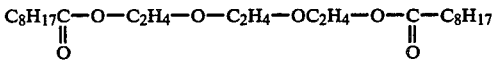

This compound is commercially available from Emery as Plastolein 9404.

The akyl substituted amide which is preferred is N,N-dimethyl oleamide of the formula:

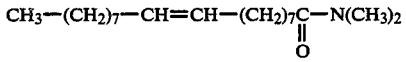

which is available from C. P. Hall under the trademark Hallcomid M-18-OL.

Those skilled in the art will recognize that compounds similar to the above preferred compounds and having similar "average" structures will be very effective, for example N,N-dimethyl linole amide.

In the prior art DNT has been used as a desensitizer. In the prior art, dynamites have contained 10% or more DNT to obtain rifle bullet insensitivity. As shown by Table 1 more than 7.5% DNT is needed to obtain rifle bullet insensitivity. The present invention uses less than 3% of the novel desensitizing compounds disclosed, and preferably from about 1% to about 2% of the novel desensitizers by weight of the dynamite composition. DNT further suffers the disadvantage of being a suspected carcinogen. Table I illustrates the effect of incorporating DNT into dynamite on its sensitivity.

TABLE I

Illustration of the Utilization of DNT with example D representing a mixture representative of prior art commercial products and examples A, B and C demonstrating the need for more than 3% DNT to achieve insensitivity

| INGREDIENTS | A | B | C | D |
|---|---|---|---|---|
| DNT | 0 | 3.0 | 7.5 | 10.0 |
| NG | 34.3 | 31.3 | 26.8 | 24.3 |
| NC (nitro cotton) | 1.4 | 1.4 | 1.6 | 1.6 |
| AN (ammonium nitrate) | 33.3 | 33.3 | 33.3 | 33.3 |
| SN (sodium nitrate) | 16.0 | 16.0 | 19.0 | 19.0 |
| Wood Pulp | 2.7 | 2.7 | 2.2 | 2.2 |
| M.B. (microbubbles) | 2.0 | 2.0 | 2.0 | 2.0 |
| Flour | 4.3 | 4.3 | 1.6 | 1.6 |
| Barytes | 4.0 | 4.0 | 4.0 | 4.0 |
| Sulfur | 1.0 | 1.0 | 1.0 | 1 |
| Chalk | 1.0 | 1.0 | 1.0 | 1 |
| Fresh | 21,000 | 18,400 | 18,000 | 15,600 |
| Velocity after 3 mo.: | 21,000 | 18,400 | 10,300 | 7,700 |
| Rifle Bullet (% No Action) | 0 | 0 | 100 | 100 |
| Gap-Fresh | 20 | — | — | 1" |
| After 3 mo. of storage | 20 | — | — | Fail 3 ctg. propagation test |

The desensitizers of the present invention are incorporated into dynamite by blending the desensitizer into the NG. The desensitized NG is then made into dynamite in the normal manner. Three readily apparent advantages of this invention are that:

1. Exactly the same production equipment can be used as is normally used. No new or different equipment is necessary.
2. The desensitized NG is safer to handle than normal NG.
3. The fumes resulting from evaporation of the NG would be reduced.

The desensitizing agents of the present invention can be incorporated in any dynamite composition in the range of up to 5.0% by weight of total dynamite composition and preferably less than about 3% by weight of the total dynamite composition. Representative compositions for semi-gelatin dynamite are:

| INGREDIENTS | WGT. % |
|---|---|
| Nitrate esters (NG, EGDN, and mixtures) | 10–25% |
| Oxidizer Salts | 80–56% |
| Carbonaceous Fuels (including water-blocking agents) | 0–10% |
| pH Stabilizer (usually chalk) | 0–4% |
| Sulfur | 0–5% |

Desensitizers useful in the present invention can be tested by the Abel Heat Test to give an indication of their suitability.

EXAMPLE I

The Abel Heat Test determines the compatibility of materials with NG and EGDN. The test consists of placing the sample to be tested in a mixture of NG and EGDN in a capped test tube. A starch iodide paper is placed in the tube and suspended above the mixture. The whole assembly is heated to about 71° C. Eventually, the nitrate esters break down, releasing $NO_2$ gas which reacts with the indicator paper. The time to change is measured. The more compatible the sample material is with the nitrate esters the longer it will take for the indicator paper to change.

Although the Abel test is useful for determining useful compounds within the novel desensitizers of the present invention it should be recognized that because of impurities, compounds within the scope of the claims of the present invention may fail the test. Commercial diesters were tested. The following commercial compounds fail the Able test but it is believed that the cause for the failure was impurities in the commercial products rather than the compounds themselves. The compounds which failed the test were:

(a) Dipropylene glycol dibenzoate, sold under the tradename Benzoflex 988,
(b) 50%/50% mixture of diethylene glycol and dipropylene glycol dibenzoate, sold under the tradename Benzoflex 50,
(c) dibutoxy ethoxy ethyl adipate, sold under the tradename Plast Hall DBEEA,
(d) dibutoxy ethyl azelate sold under the tradename DBEZ,
(e) 2,2,4-trimethyl-1,3-pentanediol diisobutyrate, sold under the tradename Kodaflex TXIB.

It is believed these compounds failed the test because of impurities in the commercial product. It is believed that these compounds would be useful with the impurities removed. All other compounds mentioned in the specification were tested and passed the Abel Heat Test.

EXAMPLES 2–24

To test the effect of each compound a control dynamite of a semi-gelatin type was made of the formula:

| INGREDIENT | WEIGHT PERCENT |
|---|---|
| Nitrate esters (10% NG/90% EGDN) | 19.0 |
| Nitro cotton | .35 |
| Ammonium Nitrate | 68.0 |
| Sodium Nitrate | 4.9 |
| Carbonaceous Fuels | 5.25 |
| Guar Flour | 1.0 |
| Sulfur | .5 |
| Chalk | 1.0 |

The above control was modified by removing 3% of the ammonium nitrate and substituting 3% of the compound indicated in Table II in the formula. The results are tabulated in Table II.

The five kilogram impact test is a standard test used to compare the impact sensitivity of explosives. In Table II a higher value than the control shows an improvement in dynamite's resistance to initiation by impact. Another test of sensitivity is the standard half cartridge gap test which is utilized to illustrate the relative effect of the desensitizing compound upon detonation properties. The gap test consists of cutting a 1.25 inch by eight inch stick in half. The blasting cap is placed in one half stick and the second half of the stick is separated from the first half of the stick by a given air gap. The largest separation distance over which the receptor charge (second half of the stick) is initiated reliably is recorded. If the desensitizing compounds adversely effect detonation properties such as the velocity or rate of detonation velocity buildup, the gap value is greatly decreased. Review of Table III demonstrates that while a compound may severely effect gap sensitivity, it may only negligibly effect impact sensitivity. Thus it is apparent that a compound does not necessarily effect the impact sensitivity and air gap sensitivity to the same degree.

It can be seen from an examination that compounds not within the group of novel desensitizers disclosed by the present invention excessively reduce air gap sensitivity, e.g., dibutyl phthalate, diethyl phthalate, bis(2-methoxy ethyl)phthalate and liquid polyester MIROSOL 09-10104.

Preferably the desensitizers should greatly affect the impact sensitivity while only minimally effecting detonation properties such as gap sensitivity. Review of Table III demonstrates that N,N-dimethyl oleamide is one of the preferred compounds reducing cap sensitivity 20% while the impact sensitivity is decreased about 60% from the control values. Other compounds exhibiting good results are dibutoxy ethyl sebacate, tri-isopropyl phenyl phosphate, tricresol phosphate, and the liquid polyesters Paraplex G-57, Paraplex G-54, and Plastol CP.

The samples were also tested for fume reduction. The reduction of fumes is particularly important in the manufacture of dynamite. Manufacturers strive to control airborne NG fumes to lessen the physiological impact on production personnel. The fume test consists of placing a five gram sample of the dynamite in a sealed vessel for ten minutes. A known volume of air is removed and the EGDN vapors are trapped on an adsorbent. The EDGN is removed from the absorbent using alcohol and analyzed by gas chromatography. The sample in question was compared to the control sample. Since the desensitizing compound is added to the nitroglycerin in the ratio of 3 parts by weight desensitizer to about 20 parts by weight NG in these examples, one would expect the fumes to reduce 15% by the general rules of chemistry. However, as can be seen from the data, some of the compounds are considerably more effective than expected and some less effective. For example, the two phosphate compounds appear quite ineffective for fume reduction while most of the liquid polyesters are quite effective.

TABLE II

| COMPOUND | TRADENAME | 5 KG IMPACT (CM) | GAP (IN) | PRODUCT FUME (%) REDUCTION |
|---|---|---|---|---|
| Control | — | 22 | 20 | — |
| 1. Alkyd Pelargonic | Varkyd 608-100 | 33 | 7 | 5 |
| 2. Liquid Polyester MW = 5000 | Paraplex G-41 | 29 | 7 | 5 |
| 3. Liquid Polyester MW = 2200 | Paraplex G-50 | 37 | 2 | 0 |
| 4. Liquid Polyester MW = 3300 | Paraplex G-54 | 37 | 9 | 30 |
| 5. Liquid Polyester MW = 4200 | Paraplex G-56 | 37 | 4 | 5 |
| 6. Liquid Polyester MW = 1924 | Paraplex G-57 | 36 | 9 | 30 |
| 7. Epoxidized Soybean Oil | Drapex 6.8 | 29 | 8 | 20 |
| 8. Oxidized Linseed Oil | Drapex 10.4 | 31 | — | 20 |
| 9. Acetyl tributyl citrate | Citroflex A | 31 | 12 | 25 |
| 10. 1,3 propane, 1,4 butane dimethyl diesters | Parasol 56 | 36 | 4 | 10 |
| 11. Glutarate Alkether diester | Plasthall CP | 38 | 9 | 15 |
| 12. N,N—dimethyl Oleoamid | Hallcomid M-18-OL | 35 | 16 | 30 |
| 13. Epoxy Ester $C_{26}H_{48}O_4$ | Epoxidized tallate | 37 | 2 | 10 |
| 14. Tricresol Phosphate | Kronitex TCP | 33 | 12 | 5 |
| 15. Tri-isopropyl phenyl phosphate | Kronitex 100 | 36 | 10 | 0 |
| 16. Dibutoxy ethyl sebacate | Plasthall DBES | 40 | 10 | 5 |
| 17. Liquid Polyester | Mirosol 09-10104 | 22 | 2 | 30 |
| 18. Di-2-ethyl hexyl adipate | Kodaflex DOA | 29 | 1 | 25 |
| 19. Glyceryl Tripropionate | Triproprionin | 39 | 5 | 25 |
| 20. Glyceryl Triacetate | Triacetin | 32 | 8 | 25 |
| 21. Proprietary | Resoflex R-296 | 23 | 3 | 0 |
| 22. Dimethyl Caprylamide | Hallcomid M-8-10 | 32 | — | — |
| 23. Mixed diester | Plastolein 9065 | 38 | 7 | 30 |
| 24. Low MW Polyester | Plastolein 9750 | 31 | — | 30 |

EXAMPLES 25–38

Another series of dynamites was made using the general semi-gelatin formula:

| INGREDIENT | PERCENT |
|---|---|
| Nitrate Esters (90% EGDN/10% NG) | 20.0 |
| Nitrocotton | .2 |
| Desensitizer Compound | 3.0 |
| Oxidizer | 71.8 |
| Carbonaceous Fuel | 3.0 |
| Guar Flour | 1.0 |
| Chalk | 1.0 |

The specific fuel, oxidizer and desensitizer are shown in Table III. The examples were tested by the standard for bullet test of the institute of Makers of Explosives (IME). This test consists of firing a steel jacketed 150 grain 30–06 caliber bullet with a muzzle velocity of 2700 ft. per second at the test material which is backed up by a ½ inch thick steel plate, from a distance of less than 100 feet. As can be seen by comparing the examples in Table III there does not appear a correlation between gap sensitivity, the 5 KG impact sensitivity or rifle bullet sensitivity.

TABLE III

| EX. # | DESENSITIZER | OXIDIZER | CARBONACEOUS FUELS | VELOCITY (FT/SEC) | GAP (IN) | 5 KG IMPACT SENSITIVITY (CM) | RIFLE BULLET SENSITIVITY |
|---|---|---|---|---|---|---|---|
| 25 | Paraplex G-54 | Ammonium Nitrate | Oat Hulls | 8,060 | — | — | |
| 26 | Paraplex G-54 | ⅔ AN: ⅓ Sodium Nitrate | Wood Pulp | 7,810 | — | — | |
| 27 | Plasthall 4141 | AN | Wood Pulp | 9,800 | 10 | 30 | Failed |
| 28 | Plasthall 4141 | ⅔ AN:⅓ SN | Oat Hulls | 8,600 | 15 | 37 | Detonated |

TABLE III-continued

| EX. # | DESENSITIZER | OXIDIZER | CARBONACEOUS FUELS | VELOCITY (FT/SEC) | GAP (IN) | 5 KG IMPACT SENSITIVITY (CM) | RIFLE BULLET SENSITIVITY |
|---|---|---|---|---|---|---|---|
| 29 | Plastolein 9065 | AN | Oat Hulls | 9,090 | 27 | 18 | Detonated |
| 30 | Plastolein 9065 | ⅔ AN:⅓ SN | Wood Pulp | 11,100 | 27 | 30 | Detonated |
| 31 | Paraplex G-57 | AN | Wood Pulp | 8,900 | — | — | — |
| 32 | Paraplex G-57 | ⅔ AN:⅓ SN | Oat Hulls | 6,700 | — | — | — |
| 33 | Triacetin | AN | Oat Hulls | 8,700 | 12 | 31 | Detonated |
| 34 | Triacetin | ⅔ AN:⅓ SN | Wood Pulp | 8,500 | 10 | 32 | Detonated |
| 35 | Hallcomid M-18-OL | AN | Wood Pulp | 10,900 | 20 | — | — |
| 36 | Hallcomid M-18-OL | ⅔ AN:⅓ SN | Oat Hulls | 8,600 | 20 | — | — |
| 37 | Plasthall CP | AN | Oat Hulls | Failed | — | — | — |
| 38 | Plasthall CP | ⅔ AN:⅓ SN | Wood Pulp | 8,100 | — | — | — |

EXAMPLES 39–43

Examples of the present invention were formulated as indicated in Tables IV and V. Table IV compositions correlated to desensitized gelatin dynamites. Corresponding commercial gelatin dynamite such as Atlas Giant Gel with no desensitizers have a velocity in the range of 7,000 to 12,000 ft/sec.

The examples of Table V illustrate desensitized ammonia dynamite made in accordance with the present invention.

TABLE IV

DESENSITIZED GELATIN DYNAMITES

| Formula | Ex. 39 | Ex. 40 | Ex. 41 |
|---|---|---|---|
| Nitrate Esters (90% EGDN:10% NG) | 25.0 | 24.5 | 25.0 |
| Nitrocotton | .75 | .75 | .75 |
| Desensitizer (Plasthall 4141) | 2.0 | 2.5 | 1.5 |
| Ammonium Nitrate | 50.25 | 50.25 | 50.75 |
| Sodium Nitrate | 17.0 | 17.0 | 17.0 |
| Oat Hulls | 2.5 | 2.5 | 2.5 |
| Flour | 1.5 | 1.5 | 1.5 |
| Chalk | 1.0 | 1.0 | 1.0 |
| Velocity (ft/sec) | 8500 | 7400 | 9000 |
| Rifle Bullet Sensitivity (% Detonate) | 33 | 0 | 67 |

TABLE V

DESENSITIZED AMMONIA DYNAMITE

| Formula | Ex. 42 | Ex. 43 |
|---|---|---|
| Nitrate Esters (90% EGDN:10% NG) | 12.5 | 13.0 |
| Nitrocotton | .1 | .1 |
| Desensitizing Compound (4141) | 2.0 | 1.5 |
| Ammonium Nitrate | 68.4 | 68.4 |
| Sodium Nitrate | 10.0 | 10.0 |
| Oat Hulls | 5.0 | 5.0 |
| Guar Flour | 1.0 | 1.0 |
| Chalk | 1.0 | 1.0 |
| Velocity (ft/sec) | 9700 | 10,000 |
| Rifle Bullet Sensitivity (% Det.) | 0 | 33 |

A corresponding velocity for comparable commercial ammonia/dynamite is 8,500–11,500 ft. per second. Such a prior art commercial ammonia/dynamite is sold by Atlas Powder Company under the tradename Atlas Extra having the following composition:

| | |
|---|---|
| Nitrate esters (90% EGDN/10% NG) | 13.5 |
| Nitrocellulose | 0.1 |

-continued

| | |
|---|---|
| Pyrocotton | — |
| Ammonium Nitrate | 46.4 |
| 12-mesh Sodium Nitrate | 10.7 |
| Wood Pulp | 0.5 |
| Sulfur | 3.0 |
| Chalk | 1.0 |
| Nitrate | 20.0 |
| Corn flour | 3.8 |
| Guar flour | 1.0 |

The comparison examples demonstrate that no apparent correlation exists between reduction, gap sensitivity, 5 kg impact sensitivity, or rifle bullet impact sensitivity with the desensitizing agents of the present invention. It is cleaar, however, that the desensitizers of the present invention are effective. The desensitizers of the present invention when incorporated into dynamite produce dynamites with acceptable detonation of properties with greatly reduced sensitivity to accidental initiation. Additionally, the desensitizers of the present invention when incorporated also reduce fumes which achieves the desirable result of reducing the possibility for headaches and other physiological effects.

While the present invention has been described in its preferred embodiments those skilled in the art will recognize other compounds and it is intended to claim all compounds within the scope of the invention.

We claim:

1. A dynamite composition of at least nitrate esters, oxidizer salts, carbonaceous fuel, antiacid the improvement comprising:

the incorporation of from about 0.5 to about 3.0% by weight of a desensitizer selected from the group consisting of:

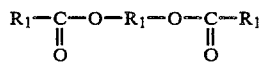

and

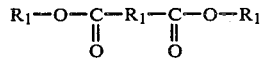

and

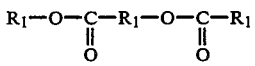

and

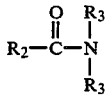

wherein $R_1$ is a $C_3$ to $C_{10}$ group, but not a benzyl ring, which can contain elements other than carbon and hydrogen, and $R_2$ is a $C_8$ to $C_{20}$ group and $R_3$ is a $C_1$ to $C_3$ group.

2. The composition of claim 1 wherein said desensitizer is present in an amount from about 1.5% to about 2.5%.

3. The composition of claim 1 wherein said $R_1$, $R_2$ and $R_3$ contain only hydrogen and carbon.

4. The composition of claim 2 wherein said $R_1$, $R_3$, and $R_2$ are carbon chains containing only the elements carbon and hydrogen.

5. The composition of claim 1 wherein said $R_3$ groups are both methyl groups.

6. The composition of claim 2 wherein said $R_3$ groups are both methyl groups.

7. The method of making a desensitized dynamite comprising admixing into a dynamite composition a sensitizer selected from the group consisting of:

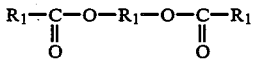

and

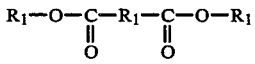

and

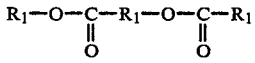

and

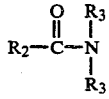

wherein $R_1$ is a $C_3$ to $C_{10}$ group, but not a benzyl ring, which can contain elements other than carbon and hydrogen; $R_2$ is a $C_8$ to $C_{20}$ group; and $R_3$ is a $C_1$ to $C_3$ group.

8. A dynamite composition of claim 1 wherein the desensitizer is:

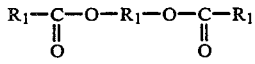

wherein $R_1$ is a $C_3$ to $C_{10}$ group, but not a benzyl ring, which can contain elements other than carbon and hydrogen.

9. A dynamite composition of claim 1 wherein said desensitizer is:

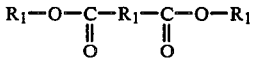

wherein $R_1$ is a $C_3$ to $C_{10}$ group, but not a benzyl ring, which can contain elements other than carbon and hydrogen.

10. A dynamite composition of claim 1 wherein said desensitizer is:

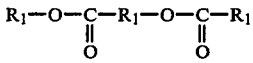

wherein $R_1$ is a $C_3$ to $C_{10}$ group, but not a benzyl ring, which can contain elements other than carbon and hydrogen.

11. A dynamite composition of claim 1 wherein said desensitizer is:

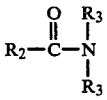

wherein $R_2$ is a $C_8$ to $C_{20}$ group and $R_3$ is a $C_1$ to $C_3$ group.

12. A dynamite composition of at least nitrate esters, oxidizer salts, carbonaceous fuel, antiacid, the improvement comprising:

the incorporation of from about 0.5 to about 3.0% by weight of a desensitizer selected from the group consisting of:

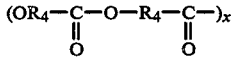

wherein x represents the average number of repeating units which make up the compound; $R_4$ is a carbon-containing group, but not a benzyl ring; and wherein said desensitizer has an average molecular weight from 1500–10,000.

13. The composition of claim 12 wherein the average molecular weight of said desensitizer has a molecular weight from 1900 to 5000.

14. The composition of claim 12 wherein $R_4$ is selected from the group consisting of adipates, sebacates, gluterates, oleates or stearates.

15. The composition of claim 13 wherein $R_4$ is selected from the group consisting of adipates, sebacates, gluterates, oleates or stearates.

16. A dynamite composition of at least nitrate esters, oxidizer salts, carbonaceous fuel, antiacid, the improvement comprising:

the incorporation of from about 0.5 to about 3.0% by weight of a desensitizer which is a triester of glycerol.

17. The composition of claim 16 wherein said triester is glyceryl triacetate.

18. The composition of claim 16 wherein said triester is glycerol tripropeonate.

* * * * *

UNITED STATES PATENT AND TRADEMARK OFFICE

CERTIFICATE OF CORRECTION

PATENT NO. : 4,595,430

DATED : June 17, 1986

INVENTOR(S) : James J. Baker

It is certified that error appears in the above-identified patent and that said Letters Patent is hereby corrected as shown below:

Column 9, Line 54, change "absorbent" to --adsorbent--.

Column 12, Line 37, change "cleaar" to --clear--.

Column 12, Line 41, change "detonation of properties" to --detonation properties--.

Column 13, Line 32, change "sensitizer" to --desensitizer--.

Signed and Sealed this

Eleventh Day of November, 1986

*Attest:*

DONALD J. QUIGG

*Attesting Officer* *Commissioner of Patents and Trademarks*